United States Patent [19]

Wehnert, III

[11] Patent Number: 4,815,628

[45] Date of Patent: Mar. 28, 1989

[54] CONTAINER SEALER

[76] Inventor: Arthur R. Wehnert, III, 1424 N. Lincoln St., Roselle, Ill. 60172

[21] Appl. No.: 211,825

[22] Filed: Jun. 27, 1988

[51] Int. Cl.[4] ..... B65D 43/04; B65D 43/08

[52] U.S. Cl. ..... 220/352; 220/258; 220/DIG. 19

[58] Field of Search ..... 220/258, 352, DIG. 19

[56] References Cited

U.S. PATENT DOCUMENTS

| | | | |
|---|---|---|---|
| 3,204,805 | 9/1965 | May | 220/258 |
| 4,162,023 | 7/1979 | Faltermeier | 220/258 |
| 4,708,257 | 11/1987 | Deline | 220/257 |
| 4,749,100 | 6/1988 | Elerhart | 220/306 |

*Primary Examiner*—George T. Hall

[57] ABSTRACT

An elastomeric cover for metallic beverage containers with easy opening tops, with an elastic side wall that grips and seals on a variety of standard containers.

14 Claims, 1 Drawing Sheet

CONTAINER SEALER

BACKGROUND OF THE INVENTION

Easy opening metallic containers have found considerable success in the marketplace, particularly 12 oz. containers for soft drinks and beer. Today these containers are constructed predominantly of thin-gauge aluminum sheeting with the bottom and side walls being drawn in a single piece rather than roll-staked together as in the past. The top wall continues to be roll-staked to the side wall and has an easy opening top consisting of a pull tab joined to a weakened closed scoreline in the top wall.

While the major outer diameters of the side walls in most 12 oz. aluminum containers of this type are substantially identical, the diameters of the top wall and the side wall adjacent the top wall are reduced in many containers and this presents a substantial problem in the design of an after-market type closure for the easy opening tops which, of course, cannot themselves be resealed.

It is a primary object of the present invention to ameliorate the problems noted above in reusable covers for beverage containers.

SUMMARY OF THE PRESENT INVENTION

In accordance with the present invention, a one-piece elastomeric reusable cover is provided for a variety of standard open beverage cans.

As noted above, while metal, usually aluminum beverage containers with snap-open tops, have fairly standardized container diameters, the top diameters of the containers are not standardized and, hence, most of the covers of which I am aware are unable to seal and lock on these different container tops.

The present reusable elastomeric cover solves this problem in part with an elongated depending annular side wall that extends from a top wall approximately 1⅛ inches so that the lower end of it may grip and seal to the largest diameter portion of the container, which as noted above is fairly standardized. To assist in the gripping and sealing action of this lower end of the cover side wall, it is provided with an integral flange that increases the gripping strength of the cover on the can.

The present cover is constructed of a highly elastomeric material such as Buta-N, Silicone Rubber, or other high elasticity and elongation materials. The elastomer preferably has an elongation in the range of 400 to 750 and a durometer in the range of 40 to 70 Shore A.

The inner diameter of the side wall is slightly less than the smallest diameter standard 12 oz. beverage can and is 2.600 inches.

Other objects and advantages will appear in the following detailed description of the invention.

DETAILED DESCRIPTION OF THE PREFERRED EMBODIMENT

Figure 1:
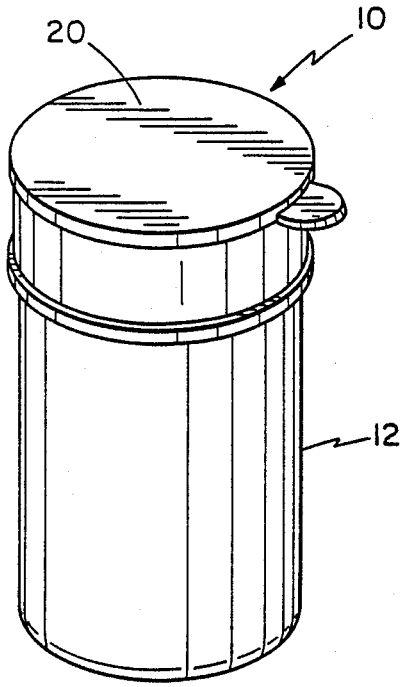
FIG. 1 is a perspective view of a standard 12 oz. beverage container with the present cover in position on top of the can.
Figure 2:
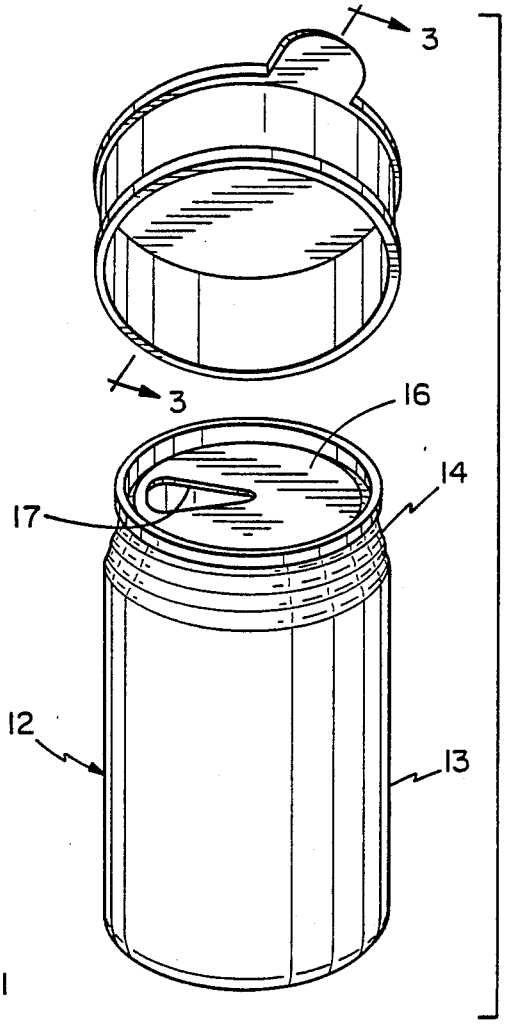
FIG. 2 is a somewhat enlarged exploded view of the beverage container cover illustrated in FIG. 1.
Figure 3:
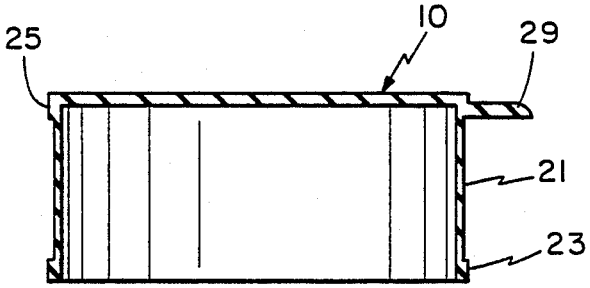
FIG. 3 is a longitudinal section of the present cover taken generally along line 3—3 of FIG. 2.
Figure 4:
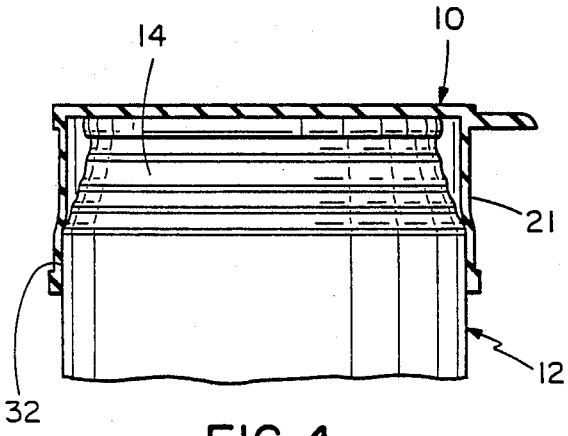
FIG. 4 is a longitudinal section of the present cover mounted and sealed on one type of standard 12 oz. beverage container.

Viewing the drawings, and particularly FIGS. 1 to 3, an elastomeric cover 10 is illustrated according to the present invention shown in FIG. 1 mounted on a standard beverage container 12, also illustrated in FIGS. 2 and 4.

This standard beverage container is seen to include a drawn aluminum annular side wall 13 having a major outer diameter of 2.585 inches with a tapered reduced upper portion 14 roll-staked to a flat reduced diameter cover 16 that has a triangular opening 17 after the removal of the snap top.

The cover 10 is constructed of a highly elastomeric material such as Buta-N rubber, one of the silicone rubbers manufactured, for example, by Dow Corning Corporation, or one of the more elastic and low durometer polyurethanes. Regardless of the type of material, however, the cover 10 is constructed of an elastomer having a durometer in the range of 40 to 70 Shore A with an elongation of 400 to 750.

Cover 10 is a one-piece molding and has a circular top wall 20 with an annular depending side wall 21. Wall 21 has a thickness in the range of 0.015 to 0.030 inches. The lower end of the wall 21 has an outwardly extending flange 23 that increases the gripping strength of the side wall 21 on the container.

Figure 5:
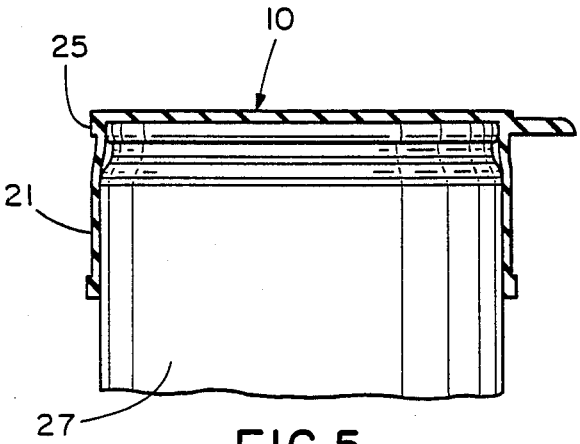
FIG. 5 is a longitudinal section of the present cover similar to FIG. 4 shown mounted on another type of standard 12 oz. beverage container.

The upper end of the side wall 21 has another flange 25 that assists in locking and sealing the cover 10 to the large upper diameter container 27 illustrated in FIG. 5. A releasing tab 29 extends integrally outwardly from flange 25 and permits the user to easily remove the cover 10 from either can type 12 or 27.

The side wall 21 extends downwardly from top wall 10 a distance of 1.125 inches so that it can extend over reduced portion 14 of can type 12 and lock and seal on large diameter portion 32 illustrated in FIG. 4. The annular side wall 21 has an inner diameter of 2.600 inches which is approximately 0.015 inches less than the smallest 12 oz. standard beverage container.

As seen in FIG. 5, when locking on the standard beverage container 27, side wall 21 locks throughout most of its length on the large diameter portion of the container and also upper flange 25 grips the roll flange on the top of the container.

In the above manner, the present cover 10 has the capability of locking and sealing a variety of standard 12 oz. beverage containers without any modification and eliminates problems heretofore found in closures for these types of containers.

I claim:

1. An elastomeric cover and seal for a variety of standardized beverage containers having non-reclosable top openings with an annular side wall joining the top including those containers that have straight side walls with a substantially constant outer diameter and those having tops with a reduced diameter and having tapered upper side wall portions, comprising: a one-piece elastomeric cover having a generally planar top wall with an integral depending side wall, said side wall having sufficient elasticity and elongation to grip and seal on the container side wall, said cover side wall also having a sufficient length to grip and seal on the constant diameter portions of both the constant diameter side wall container and those with reduced diameter upper portions.

2. An elastomeric cover and seal for a variety of standardized beverage containers as defined in claim 1, wherein the cover is constructed of an elastomeric material having an elongation in the range of 400 to 700.

3. An elastomeric cover and seal for a variety of standardized beverage containers as defined in claim 1, wherein the cover is constructed of an elastomeric material having a durometer in the range of 40 to 70 Shore A.

4. An elastomeric cover and seal for a variety of standardized beverage containers as defined in claim 1, wherein the cover side wall has a length substantially greater than $\frac{5}{8}$ths inches so it can grip and seal on the lower side wall portions of containers with reduced diameter upper side walls.

5. An elastomeric cover and seal for a variety of standardized beverage containers as defined in claim 1, wherein the cover side wall has a constant inner diameter approximately 0.015 inches less than the outer side wall diameter of the standard containers.

6. An elastomeric cover and seal for a variety of standardized beverage containers as defined in claim 5, wherein the cover side wall has an inner diameter of substantially 2.600 inches.

7. An elastomeric cover and seal for a variety of standardized beverage containers as defined in claim 4, wherein the cover side wall length is substantially 1.125 inches.

8. An elastomeric cover and seal for a variety of standardized beverage containers as defined in claim 1, including an integral pull tab extending outwardly from and substantially coplanar with the cover top wall.

9. An elastomeric cover and seal for a variety of standardized beverage containers as defined in claim 1, including an integral outwardly extending flange on the lower end of the side wall to increase the gripping strength of the cover side wall on the container side wall.

10. An elastomeric cover and seal for a variety of standardized beverage containers having non-reclosable top openings with an annular side wall joining the top including those containers that have straight side walls with a substantially constant outer diameter and those having tops with a reduced diameter and having tapered upper side wall portions, comprising: a one-piece elastomeric cover having a generally planar top wall with an integral depending side wall, said side wall having sufficient elasticity and elongation to grip and seal on the container side wall, said cover side wall also having a sufficient length to grip and seal on the constant diameter portions of both the constant diameter side wall containers and those with reduced diameter upper portions, and an integral outwardly extending flange on the lower end of the cover side wall to increase the gripping strength of the cover side wall on the container side wall, said cover being constructed of an elastomeric material having a durometer in the range of 40 to 70 Shore A.

11. An elastomeric cover and seal for a variety of standardized beverage containers as defined in claim 10, wherein the cover is constructed of an elastomeric material having an elongation in the range of 400 to 700.

12. An elastomeric cover and seal for a variety of standardized beverage containers as defined in claim 10, wherein the cover side wall has a length substantially greater than $\frac{5}{8}$ths inches so it can grip and seal on the outer side wall portions of reduced upper diameter side wall containers.

13. An elastomeric cover and seal for a variety of standardized beverage containers as defined in claim 10, wherein the cover side wall has a constant inner diameter approximately 0.015 inches less than the outer side wall diameter of the standard containers.

14. An elastomeric cover and seal for a variety of standardized beverage containers having non-reclosable top openings with an annular side wall joining the top including those containers that have straight side walls with a substantially constant outer diameter and those having tops with a reduced diameter and having tapered upper side wall portions, comprising: a one-piece elastomeric cover having a generally planar top wall with an integral depending side wall, said side wall having sufficient elasticity and elongation to grip and seal on the container side wall, said cover side wall also having a sufficient length to grip and seal on the constant diameter portions of both the constant diameter side wall containers and those with reduced diameter upper portions, an integral outwardly extending flange on the lower end of the cover side wall to increase the gripping strength of the cover side wall on the container side wall, said cover being constructed of an elastomeric material having a durometer in the range of 40 to 70 Shore A, and an elongation in the range of 400 to 700, said cover side wall having a length substantially 1.125 inches so it can grip and seal on the outer side wall portions of reduced upper diameter side wall containers and a constant inner diameter of substantially 2.600 inches, and an integral pull tab extending outwardly from and substantially coplanar with the cover top wall.

* * * * *